US005810677A

United States Patent [19]

Maruko et al.

[11] Patent Number: 5,810,677

[45] Date of Patent: Sep. 22, 1998

[54] THREAD-WOUND GOLF BALLS AND THEIR PRODUCTION PROCESS

[75] Inventors: Takashi Maruko; Shinichi Kakiuchi; Junji Umezawa, all of Saitama, Japan

[73] Assignee: Bridgestone Sports Co., Ltd., Tokyo, Japan

[21] Appl. No.: 829,343

[22] Filed: Mar. 31, 1997

[30] Foreign Application Priority Data

Apr. 2, 1996 [JP] Japan ..... 8-104533
Jun. 14, 1996 [JP] Japan ..... 8-175984

[51] Int. Cl.[6] ..... A63B 37/06; A63B 37/12

[52] U.S. Cl. ..... 473/357; 473/365; 473/377; 473/378; 264/28

[58] Field of Search ..... 473/357, 365, 473/377, 378; 264/28

[56] References Cited

U.S. PATENT DOCUMENTS 5,194,191 3/1993 Nomura et al. ..... 473/357 X

*Primary Examiner*—George J. Marlo

*Attorney, Agent, or Firm*—Sughrue, Mion, Zinn, Macpeak & Seas, PLLC

[57] ABSTRACT

The present invention provides a thread-wound golf ball comprising a thread rubber ball prepared by winding thread rubber around a spherical solid center and a cover enclosing the thread rubber ball therein, wherein the solid center satisfies the following equations (1) to (3):

$$\alpha=26 \text{ to } 34 \text{ (mm)} \quad (1)$$

$$10.0-0.25\alpha(\text{mm})<\beta<13.0-0.25\alpha(\text{mm}) \quad (2)$$

$$\gamma/\alpha<0.11 \quad (3)$$

where $\alpha$ is the diameter of the solid center, $\beta$ is the deformation of the solid center under a load of 30 kg at room temperature, and $\gamma$ is the deformation of the solid center frozen through the use of dry ice as measured 1 minute after application of a load of 50 kg to the frozen solid center at room temperature. The thread-wound golf ball has stable quality due to an undeformed solid center and provides a long travel distance through the use of a large-diameter, low-hardness solid center.

10 Claims, 1 Drawing Sheet

THREAD-WOUND GOLF BALLS AND THEIR PRODUCTION PROCESS

BACKGROUND OF THE INVENTION

1. Field of the Invention

The present invention relates to a thread-wound golf ball using a solid center. More particularly it relates to a thread-wound golf ball having stable quality through the use of an undeformed solid center and providing a long travel distance through the use of a large-diameter, low-hardness solid center, and to a process for producing the thread-wound golf ball.

2. Related Art

Thread-wound golf balls are prepared by winding thread rubber around a spherical center to form a thread rubber ball, and then enclosing the thread rubber ball with a cover. There are two types of centers, i.e. a liquid center and a solid center. The liquid center is prepared by enclosing a liquid in a spherical rubber bag, whereas the solid center is prepared by molding rubber into a spherical shape. Thread-wound golf balls are advantageous in terms of their soft feel on impact and excellent spin properties (easy to impart spin) as compared to two-piece balls, and thus are preferred by professional golfers and skilled golfers. Thread-wound golf balls are, however, disadvantageous in terms of travel distance as compared to two-piece balls.

In order to solve the above disadvantage, there have heretofore been proposed thread-wound golf balls using a solid center in which the diameter of the solid center is increased and/or the hardness of the solid center is reduced to reduce spin quantity on impact, thereby increasing travel distance. For example, thread-wound golf balls as described in the following items 1) to 8) are known.

1) A thread-wound golf ball using a solid center having a diameter of 30 to 38 mm, a specific gravity of not more than 1.10, and a compression strength of 1.0 to 2.0 mm (measured in amount of distortion) (Kokai S59-129072).
2) A thread-wound golf ball, when having a diameter of 1.62 inch, using a solid center having an outer diameter of 27 to 30 mm, a JIS-A hardness of 75 to 85 and a weight of 20.5 to 23.5 g, and when having a diameter of 1.68 inch, using a solid center having a diameter of 28 to 32 mm, a JIS-A hardness of 70 to 80, and a weight of 17.5 to 21.0 g (Kokoku H04-25029).
3) A thread-wound golf ball using a solid center having a JIS-C hardness of 65 to 90 and a diameter of 33 to 38 mm (Kokoku H06-4104).
4) A thread-wound golf ball having a diameter of 1.68 inch and using a solid center having a diameter of 23.5 to 25.5 mm, a weight of 13.0 to 15.0 g, a JIS-A hardness of 70 to 95, and a compressive fracture strength of at least 450 kgf (Kokai H5-317458).
5) A thread-wound golf ball using a solid center formed of a cross-linked rubber component including an oily substance therein and having a restitution elasticity of at least 90 cm (Kokai H05-337217).
6) A thread-wound golf ball using a solid center which has a JIS-A surface hardness of not more than 60 and which deforms at least 0.5 mm under a load of 500 g (Kokai H06-54930).
7) A thread-wound golf ball using a solid center which comprises a core formed of a cross-linked rubber including an oily substance therein, and coated with an oil resistant material (Kokai H07-39607).

8) A thread-wound golf ball using a solid center which has a diameter of 30 to 35 mm and whose deformation amount varies from 1.2 to 2.5 mm when the load acting on the solid center is increased from an initial load of 10 kg to a final load of 30 kg (Kokai H07-313630).

In a process for producing a thread-wound golf ball having a liquid center, the liquid center is frozen through the use of dry ice, liquid nitrogen, or the like before thread rubber is wound therearound, to maintain the shape of the liquid center. By contrast, in a process for producing a thread-wound golf ball using a solid center, freezing the solid center before thread rubber is wound therearound is not normal practice. However, when a solid center having a low hardness is used to increase travel distance as described previously, the solid center is frozen through the use of dry ice, liquid nitrogen, or the like before thread rubber is wound therearound to maintain the shape of the solid center, because winding thread rubber around the solid center at room temperature may cause the solid center to deform.

However, in a process for producing a thread-wound golf ball using a solid center having a low hardness, even when thread rubber is wound around a frozen solid center, in some cases, the solid center deforms during the winding of thread rubber therearound, resulting in impaired quality. Thus, there has been demand for means of preventing such deformation of a solid center. According to an investigation conducted by the present inventors, as a solid center increases in diameter and becomes softer, frequency of deformation of the solid center increases, resulting in increased likelihood of impairment of quality.

SUMMARY OF THE INVENTION

The present invention has been made in view of the above-mentioned situations. Thus, it is an object of the present invention to provide a thread-wound golf ball which has stable quality due to an undeformed solid center and which provides a long travel distance through the use of a large-diameter, low-hardness solid center.

Another object of the present invention is to provide a process for producing the thread-wound golf ball as described above.

In order to achieve the above object, the present inventors carried out extensive studies based on the aforementioned finding that frequency of deformation of the solid center increases as the solid center increases in diameter and becomes softer. As a result, it was found that deformation of a solid center during the winding of thread rubber therearound can be prevented by setting within specific ranges the diameter of a solid center and the relation between the diameter and the hardness of a solid center (specifically, the deformation of a solid center under a load of 30 kg at room temperature; this deformation may hereinafter be referred to as the hardness of a solid center in some cases). Further, as an index of freezing properties (hardness in frozen state, difficulty to thaw, etc.) of the solid center, the present inventors employed the deformation of a solid center frozen through the use of dry ice as measured 1 minute after application of a load of 50 kg to the frozen solid center at room temperature (this deformation may hereinafter referred to as a freezing properties index of a solid center in some cases). As a result, it was found that deformation of a frozen solid center during the winding of thread rubber therearound can be prevented by setting the relation between the diameter of the solid center and the freezing properties index within a specific range. In this case, the deformation of a frozen solid center as measured 1 minute after application of a predetermined load to the frozen solid center is employed as a freezing properties index because it takes not more than about 1 minute to complete thread rubber winding; in other words, the deformability of a frozen solid center during the winding of thread rubber therearound can be evaluated from the hardness of the frozen solid center as measured 1 minute after application of a predetermined load thereto.

More specifically, taking the diameter of a solid center as $\alpha$ (mm), the deformation of a solid center under a load of 30 kg at room temperature as $\beta$ (mm), and the deformation of a solid center frozen through the use of dry ice as measured 1 minute after application of a load of 50 kg to the frozen solid center at room temperature as $\gamma$ (mm), the present inventors found that deformation of a frozen solid center during the winding of thread rubber therearound can be prevented when the solid center meets the following conditions: $\alpha$ falls within a specific range, $\alpha$ and $\beta$ satisfy a specific relation, and $\alpha$ and $\gamma$ satisfy a specific relation. As a result there is obtained a thread-wound golf ball having a large-diameter, low hardness, deformation-free solid center. The present invention has been achieved based on these findings.

Accordingly, the present invention provides a thread-wound golf ball comprising a thread rubber ball prepared by winding thread rubber around a spherical solid center and a cover enclosing the thread rubber ball therein, wherein the solid center satisfies the following equations (1) to (3):

$$\alpha=26 \text{ to } 34 \text{ (mm)} \quad (1)$$

$$10.0-0.25\alpha(\text{mm})<\beta<13.0-0.25\alpha(\text{mm}) \quad (2)$$

$$\gamma/\alpha<0.11 \quad (3)$$

where, $\alpha$ is the diameter of the solid center, $\beta$ is the deformation of the solid center under a load of 30 kg at room temperature, and $\gamma$ is the deformation of the solid center frozen through the use of dry ice as measured 1 minute after application of a load of 50 kg to the frozen solid center at room temperature.

Also, the present invention provides a process for producing a thread-wound golf ball, comprising the steps of: freezing a spherical solid center, which meets the above equations (1) to (3); winding thread rubber around the frozen solid center to obtain a thread rubber ball; and enclosing the thread rubber ball with a cover.

The present invention employs the following technical features (a) to (c) in combination to thereby prevent deformation of a frozen solid center during the winding of thread rubber therearound and to implement a large-diameter, low-hardness solid center. Thus, a thread-wound golf ball having stable quality and providing a long travel distance is obtained.

(a) The diameter $\alpha$ of a solid center is in a large-diameter range of 26 to 34 mm, thereby reducing the spin quantity of a golf ball on impact.

(b) The hardness $\beta$ of a solid center is in a low-hardness range which satisfies equation (2), thereby reducing the spin quantity of a golf ball on impact.

(c) The freezing properties index $\gamma$ is set to be equal to or less than 0.11 times the diameter a of a solid center so as to increase the hardness of the frozen solid center during the winding of thread rubber therearound, thus preventing deformation of the frozen solid center during the winding of thread rubber therearound.

The thread-wound golf ball of the present invention has stable quality due to an undeformed solid center and provides a long travel distance through the use of a large-diameter, low-hardness solid center. Also, the production process of the present invention advantageously produces the thread-wound golf ball.

PREFERRED EMBODIMENTS OF THE INVENTION

Figure 1:
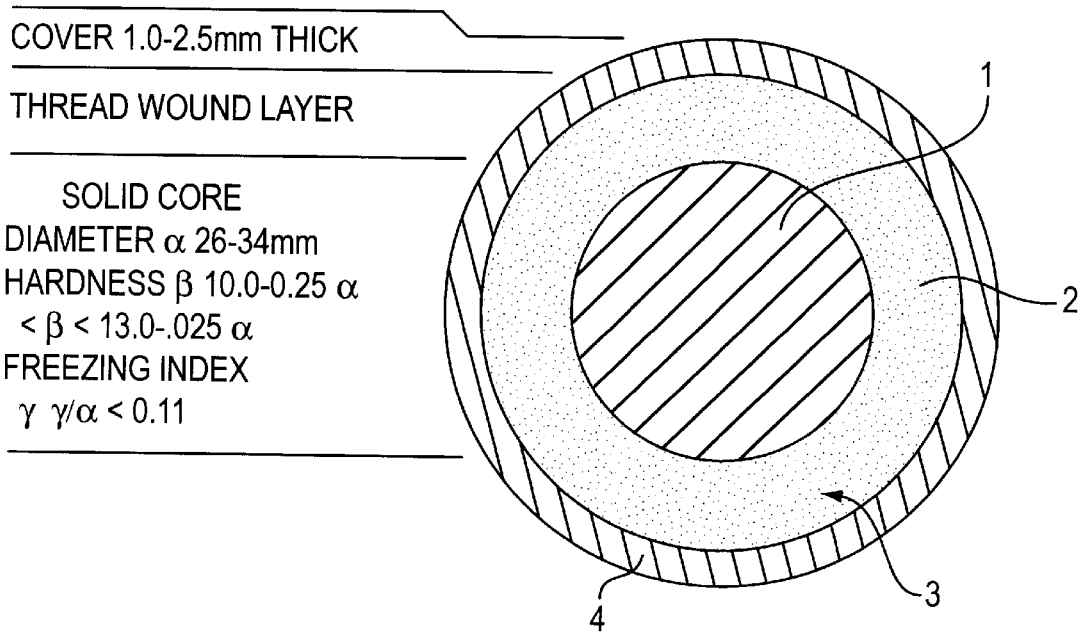
FIG. 1, the only FIGURE, illustrates the invention.

The present invention will be described in more detail below.

In the present invention, the solid center 1 has a diameter $\alpha$ of 26 to 34 mm. When the diameter is less than 26 mm, the low spin, when hit, of the resulting golf ball cannot be obtained, resulting in short travel distance. When the diameter exceeds 34 mm, sufficient amount of thread rubber cannot be wound on the solid center, resulting in failure to obtain good restitution properties. In this case, if the elongation rate of thread rubber is increased to secure good restitution properties, durability of the resulting golf ball will decrease. The solid center may preferably have a diameter of 28 to 34 mm, particularly 30 to 32 mm.

The solid center 1 used in the present invention has the deformation $\beta$ (mm) under a load of 30 kg at room temperature (about 20° to 25° C.) of greater than ($10.0-0.25\alpha$ (mm)) and less than ($13.0-0.25\alpha$(mm)). When $\beta$ is not more than ($10.0-0.25\alpha$(mm)) (i.e. when the center is hard), the restitution properties of the center may become poor, resulting in poor restitution properties of the resulting golf ball and an increased spin quantity thereof. Thus, the resulting golf ball may give short travel distance. When $\beta$ exceeds ($13.0-0.25\alpha$(mm)) (i.e. when the center is soft), frequency of deformation in a thread winding step may increase. The $\beta$ value more preferably falls in a range of ($10.5-0.25\alpha$) to ($12.5-0.25\alpha$), particularly ($11.0-0.25\alpha$) to ($12.5-0.25\alpha$).

The solid center used in the present invention has a $\gamma/\alpha$ ratio of less than 0.11, where $\alpha$ is the diameter of the solid center and $\gamma$ is a freezing properties index, i.e. the deformation (mm) of the solid center frozen through the use of dry ice as measured 1 minute after application of a load of 50 kg to the frozen solid center at room temperature (about 20° to 25° C.). When the $\gamma/\alpha$ ratio is not less than 0.11, the frozen solid center is likely to deform due to insufficient hardness of the frozen solid center during the winding of thread rubber therearound. The $\gamma/\alpha$ ratio more preferably falls in a range of 0.05 to 0.10, particularly 0.05 to 0.08. The $\gamma$ value preferably falls in a range of 2.0 to 3.5, particularly 2.0 to 3.0.

The materials of the solid center 1 used in the present invention are not particularly limited, but the solid center is preferably formed of vulcanized rubber. In this case, suitable base rubber may include, for example, polybutadiene rubber or a blend of polybutadiene rubber and polyisoprene rubber. To obtain high coefficient of restitution, particularly preferred is 1,4-polybutadiene rubber having at least 90 percent of cis-configuration. The solid center made of vulcanized rubber may be prepared by adding, to the above base rubber, an additive such as a vulcanizing agent (cross-linker), vulcanization accelerator, vulcanization accelerator aid, activating agent, filler, modifier or antioxidant as desired, and then, subjecting the obtained mixture to vulcanization and molding.

Organic peroxide and cocross-linker may be used in vulcanization and molding of the solid center, suitable organic peroxide may include, for example, dicumyl peroxide and a blend of dicumyl peroxide and 1,1-bis(t-butylperoxy)-3,3,5-trimethylcyclohexane. The amount of organic peroxide used may usually ranges from 0.5 to 1.5 parts by weight based on 100 parts by weight of base rubber. Examples of suitable cocross-linker include zinc salts or magnesium salts of unsaturated fatty acids such as methacrylic acid or acrylic acid, and esters such as trimethylpropane trimethacrylate. To obtain high coefficient of restitution, zinc acrylate is particularly preferred. The amount of cocross-linker used usually ranges from 5 to 30 parts by weight based on 100 parts by weight of base rubber.

In the present invention, means for lowering the ratio of the freezing properties index $\gamma$ (mm) of the solid center to the diameter $\alpha$ (mm) of the solid center ($\gamma/\alpha$) below 0.11 may be either of the following: (a) a process oil having a fluid point of −10° C. or higher is used in an amount of 5 to 10 parts by weight, preferably 6 to 8 parts by weight, based on 100 parts by weight of a rubber component and (b) natural rubber accounts for 0 to 10 wt.%, preferably 3 to 8 wt. % of a rubber component.

The process oil used in the above-described means (a) is not particularly limited, but may be an oil from the group comprising paraffin-based process oils, naphthene-based process oils, and aromatic-based process oils. The process oil used preferably has a fluid point of −10° C. or higher, particularly −5° to 10° C. When the fluid point of the process oil used is lower than −10° C., the $\gamma/\alpha$ ratio may not decrease below 0.11. Further even when the process oil having a fluid point of −10° C. or higher is used, the process oil, when added in an amount of less than 5 parts by weight, may not produce much effect. As a result, the $\gamma/\alpha$ ratio may not decrease below 0.11. When amount of the process oil used exceeds 10 parts by weight, the restitution properties of the solid center may become poor at low temperatures. In the above-described means (b), when the natural rubber content exceeds 10 wt. %, the restitution properties of the solid center may become poor at low temperatures.

The thread-wound golf balls of the present invention may be prepared by freezing the above-mentioned solid center which satisfies the above-mentioned equations (1) to (3), through the use of dry ice, liquid nitrogen or the like, winding thread rubber 2 around the frozen solid center to form a thread rubber ball 3, and then enclosing the thread rubber ball with a cover 4 by compression molding or injection molding, and forming dimples. In this case, the material and the type of the thread rubber and the cover, and the diameter and the weight of the thread rubber ball and the resulting golf ball, can be freely selected.

For example, the thread rubber 2 may include, for example, those prepared by subjecting natural rubber, or a blend of natural rubber and polyisoprene rubber to vulcanization and molding. The cover 4 may be made of an ionomer resin, balata, thermoplastic polyurethane or the like in the form of a single layer or a multiple layer. In this case, the thickness of the cover preferably ranges from 1.0 to 2.5 mm. The thread-wound golf balls of the present invention may comply with the golf rules in their size and weight, and may be formed to have a diameter of at least 42.67 mm and a weight of not greater than 45.92 g. In addition, preferably the golf balls may have a deformation under a load of 100 kg of 2.6 to 3.6 mm in view of feel on impact, restitution properties and durability.

EXAMPLES

The present invention will be described in more detail with reference to the following Examples which do not restrict the present invention. First, solid centers A to O as shown in Tables 1 to 3 were prepared. These solid centers were prepared by subjecting rubber compositions as shown in Tables 1 to 3 to vulcanization at 155° C. for 15 minutes. In this case, process oil 1 used was DIANA PROCESS OIL AH-58 (fluid point 10° C.) manufactured by Idemitsu Kosan Co. Ltd., process oil 2 used was LIGHT PROCESS OIL 20 (fluid point −32.5° C.) manufactured by Mitsubishi Oil Co., Ltd., and dicumyl peroxide used was PERCUMYL D manufactured by Nippon Oil & Fats Co., Ltd.

The results of measurement of the diameter $\alpha$, weight, hardness $\beta$, and freezing properties index $\gamma$ of the solid centers are shown in Tables 1 to 3. The hardness $\beta$ was determined by amount of deformation under a load of 30 kg applied to the solid center. The freezing properties index $\gamma$ was determined by amount of deformation of the solid center frozen through the use of dry ice as measured 1 minute after application of a load of 50 kg to the frozen solid center.

Next, thread-wound golf balls as shown in Examples 1 to 15 were prepared by winding thread rubber around the above-mentioned solid centers A to O to form thread rubber balls (thread-wound cores) having a diameter of 40.4 mm, and then enclosing each of the thread rubber balls with a cover (single layer) by compression molding. In this case, the solid centers were frozen before thread rubber was wound therearound, by placing them together with dry ice in a ball mill and rotating the ball mill for 2 hours. The thread rubber used has the formulation shown below and a specific gravity of 0.93. It took about 1 minute to wind thread rubber around the solid center.

The covers used were balata covers having Formulation A shown below and thermoplastic polyurethane covers having Formulation B shown below. The balata cover having Formulation A had a specific gravity of 1.10 and a JIS-C hardness of 75. The thermoplastic polyurethane cover having Formulation B had a specific gravity of 1.18 and a JIS-A hardness of 91. In this case, the thread-wound golf ball using the balata cover was prepared by covering the thread rubber ball with a pair of half shells formed of the balata cover material of Formulation A, compression-molding the resulting covered thread rubber ball at about 85° C. for 10 minutes, and subsequently subjecting the resulting compression-molded ball to dip vulcanization for 48 hours. The thread-wound golf ball using the thermoplastic polyurethane cover was prepared by covering the thread rubber ball with a pair of half shells formed of the thermoplastic polyurethane cover material of Formulation B, and then compression-molding the resulting covered thread rubber ball at about 160° C. for 5 minutes. Thermoplastic polyurethane of Formulation B used was PANDEX T-7890 manufactured by Dainippon Ink & Chemicals Inc.

| Formulation for Thread Rubber (parts by weight): | |
|---|---|
| Polyisoprene rubber | 70 |
| Natural rubber | 30 |
| Zinc flower | 1.5 |
| Stearic acid | 1 |
| Vulcanization accelerator | 1.5 |
| Sulfur | 1 |
| **Formulation A for Cover (parts by weight):** | |
| Synthetic transpolyisoprene | 75 |
| High styrene resin | 15 |
| Natural rubber | 10 |
| Zinc flower | 10 |

-continued

| | |
|---|---|
| Titanium oxide | 10 |
| Stearic acid | 1 |
| Vulcanization accelerator | 0.5 |
| Sulfur | 1 |
| Formulation B for Cover (parts by weight): | |
| Thermoplastic polyurethane | 100 |
| Titanium oxide | 5.3 |
| Magnesium stearate | 0.5 |
| Vulcanization accelerator | 0.5 |
| Sulfur | 1 |

Tables 4 to 6 show the values of (10.0–0.25α(mm)), (13.0–0.25α(mm)) and γ/α of the solid centers, center deformation rate, and thread-wound golf ball properties. The center deformation rate represents the percentage of thread-wound golf balls whose center was fluoroscopically evaluated as nonspherical, to 50 fluoroscopically examined thread-wound golf balls of each Example. The hardness of the golf balls was determined by amount of deformation under a load of 100 kg applied to the golf balls.

The thread-wound golf balls prepared in Examples 1 to 15 were subjected to distance test. In the distance test, using a hitting test machine, the balls were hit by a No. 1 Wood at a head speed of 45 m/s, to measure initial velocity, spin quantity, launch angle, carry travel distance and total travel distance. The initial velocity was measured at a ball temperature of 5° C. and 23° C. The spin quantity, launch angle, carry travel distance and total travel distance were measured only at a ball temperature of 23° C. The results are shown in Tables 4 to 6.

For the thread-wound golf balls of Examples 1 to 6, 8, and 11 to 13, their solid centers comply with the aforementioned equations (1) to (3). Thus, the center deformations of these golf balls are zero during the winding of thread rubber around their frozen solid centers. Accordingly, these golf balls show stable quality because of the undeformed solid centers and provide a long travel distance through the use of the large-diameter, low-hardness solid centers. However, the golf ball of Example 8 shows slightly poor restitution properties at a low temperature (initial velocity at 5° C.), since process oil (fluid point 10° C.) was used in an amount of 15 parts by weight based on 100 parts by weight of the rubber component. The golf ball of Example 11 also shows slightly poor restitution properties at a low temperature, since natural rubber accounts for 15 wt. % of the rubber component.

By contrast, the golf balls having a γ/α value of not less than 0.11 (Examples 7, 9, 10 and 14) show a high center deformation rate during the winding of thread rubber around their frozen solid centers due to a large deformation γ (mm) of the frozen solid centers, indicating that their quality is unstable. The golf balls of Examples 10 and 14 having a solid center hardness β (mm) above (13.0–0.25α) show a relatively small spin quantity on impact due to their solid centers being too soft, indicating impairment of the feature of a thread-wound golf ball that spin properties are excellent. The golf ball of Example 15 having a solid center hardness β (mm) of less than (10.0–0.25α) shows a relatively large spin quantity due to its solid center being too hard and thus shows a relatively poor travel distance.

TABLE 1

| | | Solid Centers | | | | | |
|---|---|---|---|---|---|---|---|
| | | A | B | C | D | E | F |
| Formulation (p.b.w.) | Polybutadiene Rubber | 95 | 95 | 95 | 90 | 100 | 100 |
| | Natural Rubber | 5 | 5 | 5 | 10 | — | 5 |
| | Zinc Acrylate | 11 | 15 | 9 | 11 | 11 | 11 |
| | Zinc Flower | 30 | 30 | 30 | 30 | 30 | 30 |
| | Barium Sulfate | 62 | 61 | 63 | 61 | 61 | 50 |
| | Process Oil 1 | 8 | 8 | 8 | 5 | 8 | 8 |
| | Process Oil 2 | — | — | — | — | — | — |
| | Dicumyl Peroxide | 1.2 | 1.2 | 1.2 | 1.2 | 1.2 | 1.2 |
| Diameter (mm): α | | 28.0 | 28.0 | 28.0 | 28.0 | 28.0 | 28.0 |
| Weight (g) | | 16.9 | 16.9 | 16.8 | 16.9 | 16.9 | 16.2 |
| Hardness (mm): β | | 4.8 | 3.5 | 5.3 | 5.0 | 4.4 | 4.9 |
| Freezing Properties Index (mm): γ | | 2.0 | 2.0 | 2.2 | 2.2 | 2.8 | 2.0 |

TABLE 2

| | | Solid Centers | | | | |
|---|---|---|---|---|---|---|
| | | G | H | I | J | K |
| Formulation (p.b.w.) | Polybutadiene Rubber | 95 | 95 | 95 | 95 | 85 |
| | Natural Rubber | 5 | 5 | 5 | 5 | 15 |
| | Zinc Acrylate | 11 | 15 | 11 | 8 | 12 |
| | Zinc Flower | 30 | 30 | 30 | 30 | 30 |
| | Barium Sulfate | 57 | 67 | 64 | 63 | 63 |
| | Process Oil 1 | — | 15 | — | 8 | 8 |
| | Process Oil 2 | — | — | 8 | — | — |
| | Dicumyl Peroxide | 1.2 | 1.2 | 1.2 | 1.2 | 1.2 |
| Diameter (mm): α | | 28.0 | 28.0 | 28.0 | 28.0 | 28.0 |
| Weight (g) | | 16.9 | 16.9 | 16.9 | 16.9 | 16.9 |
| Hardness (mm): β | | 3.5 | 4.6 | 4.6 | 6.0 | 4.8 |
| Freezing Properties Index (mm): γ | | 3.7 | 2.0 | 3.6 | 3.3 | 2.1 |

TABLE 3

| | | Solid Centers | | | |
|---|---|---|---|---|---|
| | | L | M | N | O |
| Formulation (p.b.w.) | Polybutadiene Rubber | 95 | 100 | 95 | 95 |
| | Natural Rubber | 5 | — | 5 | 5 |
| | Zinc Acrylate | 17 | 17 | 10 | 23 |
| | Zinc Flower | 20 | 20 | 20 | 20 |
| | Barium Sulfate | 40 | 40 | 42 | 37 |
| | Process Oil 1 | 8 | 8 | 8 | 8 |
| | Process Oil 2 | — | — | — | — |
| | Dicumyl Peroxide | 1.2 | 1.2 | 1.2 | 1.2 |
| Diameter (mm): α | | 32.0 | 32.0 | 32.0 | 32.0 |
| Weight (g) | | 22.6 | 22.5 | 22.5 | 22.5 |
| Hardness (mm): β | | 3.3 | 3.2 | 5.2 | 1.9 |

TABLE 3-continued

| | Solid Centers | | | |
|---|---|---|---|---|
| | L | M | N | O |
| Freezing Properties Index (mm): γ | 2.9 | 3.0 | 3.9 | 1.7 |

TABLE 4

| | Examples | | | | | |
|---|---|---|---|---|---|---|
| | 1 | 2 | 3 | 4 | 5 | 6 |
| Center | | | | | | |
| Formulation | A | B | C | D | E | F |
| Process Oil (p.b.w.) | 8 | 8 | 8 | 5 | 8 | 8 |
| Fluid Point of Process Oil (°C.) | 10 | 10 | 10 | 10 | 10 | 10 |
| Diameter (mm): α | 28.0 | 28.0 | 28.0 | 28.0 | 28.0 | 28.0 |
| Hardness (mm): β | 4.8 | 3.5 | 5.3 | 5.0 | 4.4 | 4.9 |
| 10.0-0.25α (mm) | 3.0 | 3.0 | 3.0 | 3.0 | 3.0 | 3.0 |
| 13.0-0.25α (mm) | 6.0 | 6.0 | 6.0 | 6.0 | 6.0 | 6.0 |
| Freezing Properties Index (mm): γ | 2.0 | 2.0 | 2.2 | 2.2 | 2.8 | 2.0 |
| γ/α | 0.07 | 0.07 | 0.08 | 0.08 | 0.10 | 0.07 |
| Cover | A | A | A | A | A | B |
| Ball | | | | | | |
| Diameter (mm) | 42.68 | 42.67 | 42.68 | 42.68 | 42.68 | 42.70 |
| Weight (g) | 45.1 | 45.1 | 45.2 | 45.2 | 45.2 | 45.2 |
| Hardness (mm) *1 | 2.75 | 2.73 | 2.77 | 2.74 | 2.77 | 2.79 |
| Center Deformation Rate (%) | 0.0 | 0.0 | 0.0 | 0.0 | 0.0 | 0.0 |
| Distance Test: W#1, HS = 45 m/s | | | | | | |
| Initial Velocity (m/s) | | | | | | |
| 23° C. | 65.6 | 65.5 | 65.6 | 65.3 | 65.7 | 65.6 |
| 5° C. | 62.5 | 62.4 | 62.5 | 62.1 | 62.8 | 63.0 |
| Spin Quantity (rpm) | 3200 | 3250 | 3180 | 3200 | 3260 | 3290 |
| Launch Angle (degree) | 12.0 | 12.1 | 12.0 | 11.9 | 12.1 | 12.1 |
| Carry Travel Distance (m) | 203.5 | 203.0 | 203.3 | 202.6 | 204.4 | 204.2 |
| Total Travel Distance (m) | 219.6 | 219.2 | 220.0 | 218.4 | 220.5 | 220.0 |

*1 Deformation under a load of 100 kg

TABLE 5

| | Examples | | | | |
|---|---|---|---|---|---|
| | 7 | 8 | 9 | 10 | 11 |
| Center | | | | | |
| Formulation | G | H | I | J | K |
| Process Oil (p.b.w.) | 0 | 15 | 8 | 5 | 8 |
| Fluid Point of Process Oil (°C.) | 10 | 10 | −32.5 | 10 | 10 |
| Diameter (mm): α | 28.0 | 28.0 | 28.0 | 28.0 | 28.0 |
| Hardness (mm): β | 3.5 | 4.8 | 4.6 | 6.0 | 4.8 |
| 10.0-0.25α (mm) | 3.0 | 3.0 | 3.0 | 3.0 | 3.0 |
| 13.0-0.25α (mm) | 6.0 | 6.0 | 6.0 | 6.0 | 6.0 |
| Freezing Properties Index (mm): γ | 3.7 | 2.0 | 3.6 | 3.3 | 2.1 |
| γ/α | 0.13 | 0.07 | 0.13 | 0.12 | 0.08 |
| Cover | A | A | A | A | A |
| Ball | | | | | |
| Diameter (mm) | 42.67 | 42.67 | 42.68 | 42.68 | 42.68 |
| Weight (g) | 45.2 | 45.2 | 45.1 | 45.2 | 45.2 |
| Hardness (mm) *1 | 2.75 | 2.75 | 2.76 | 2.77 | 2.74 |
| Center Deformation Rate (%) | 36.0 | 0.0 | 52.0 | 24.0 | 0.0 |
| Distance Test: W#1, HS = 45 m/s | | | | | |

TABLE 5-continued

| | Examples | | | | |
|---|---|---|---|---|---|
| | 7 | 8 | 9 | 10 | 11 |
| Initial Velocity (m/s) | | | | | |
| 23° C. | 65.6 | 65.3 | 65.5 | 65.6 | 65.1 |
| 5° C. | 63.0 | 61.4 | 63.0 | 62.5 | 61.5 |
| Spin Quantity (rpm) | 3200 | 3190 | 3200 | 3100 | 3170 |
| Launch Angle (degree) | 12.0 | 11.9 | 12.0 | 11.8 | 11.7 |
| Carry Travel Distance (m) | 202.9 | 202.7 | 203.2 | 203.0 | 200.1 |
| Total Travel Distance (m) | 218.3 | 219.0 | 219.3 | 221.0 | 216.6 |

*1 Deformation under a load of 100 kg

TABLE 6

| | Examples | | | |
|---|---|---|---|---|
| | 12 | 13 | 14 | 15 |
| Center | | | | |
| Formulation | L | M | N | O |
| Process Oil (p.b.w.) | 8 | 8 | 8 | 8 |
| Fluid Point of Process Oil (°C.) | 10 | 10 | 10 | 10 |
| Diameter (mm): α | 32.0 | 32.0 | 32.0 | 32.0 |
| Hardness (mm): β | 3.3 | 3.2 | 5.2 | 1.9 |
| 10.0-0.25α (mm) | 2.0 | 2.0 | 2.0 | 2.0 |
| 13.0-0.25α (mm) | 5.0 | 5.0 | 5.0 | 5.0 |
| Freezing Properties Index (mm): γ | 2.9 | 3.0 | 4.0 | 1.7 |
| γ/α | 0.09 | 0.09 | 0.13 | 0.05 |
| Cover | A | A | A | A |
| Ball | | | | |
| Diameter (mm) | 42.68 | 42.68 | 42.67 | 42.68 |
| Weight (g) | 45.2 | 45.2 | 45.2 | 45.2 |
| Hardness (mm) *1 | 3.05 | 3.03 | 3.05 | 3.06 |
| Center Deformation Rate (%) | 0.0 | 0.0 | 62.0 | 0.0 |
| Distance Test: W#1, HS = 45 m/s | | | | |
| Initial Velocity (m/s) | | | | |
| 23° C. | 65.6 | 65.8 | 65.6 | 65.3 |
| 5° C. | 62.5 | 62.8 | 62.5 | 62.2 |
| Spin Quantity (rpm) | 3050 | 3000 | 2950 | 3220 |
| Launch Angle (degree) | 12.0 | 12.0 | 11.9 | 12.2 |
| Carry Travel Distance (m) | 205.5 | 206.1 | 205.5 | 203.8 |
| Total Travel Distance (m) | 222.5 | 223.5 | 222.8 | 219.7 |

*1 Deformation under a load of 100 kg

What is claimed is:

1. A thread-wound golf ball comprising a thread rubber ball prepared by winding thread rubber around a spherical solid center and a cover enclosing the thread rubber ball therein, wherein the solid center satisfies the following equations (1) to (3):

$$\alpha=26 \text{ to } 34 \text{ (mm)} \quad (1)$$

$$10.0-0.25\alpha(\text{mm})<\beta<13.0-0.25\alpha(\text{mm}) \quad (2)$$

$$\gamma/\alpha<0.11 \quad (3)$$

where α is the diameter of the solid center, β is the deformation of the solid center under a load of 30 kg at room temperature, and γ is the deformation of the solid center frozen through the use of dry ice as measured 1 minute after application of a load of 50 kg to the frozen solid center at room temperature.

2. A thread-wound golf ball according to claim 1, wherein γ/α is in the range of from 0.05 to 0.10.

3. A thread-wound golf ball according to claim 1, wherein the solid center is formed of vulcanized rubber.

4. A thread-wound golf ball according to claim 1, wherein the solid center contains a process oil having a fluid point of −10° C. or higher in an amount of 5 to 10 parts by weight based on 100 parts by weight of rubber contained in the solid center.

5. A thread-wound golf ball according to claim 1, wherein the solid center contains natural rubber in an amount of 0 to 10 wt. % based on the total amount of rubber contained in the solid center.

6. A process for producing a thread-wound golf ball, comprising the steps of freezing a spherical solid center;

winding thread rubber around the frozen solid center to obtain a thread rubber ball; and enclosing the thread rubber ball with a cover, wherein the solid center satisfies the following equations (1) to (3):

$$\alpha=26 \text{ to } 34 \text{ (mm)} \quad (1)$$

$$10.0-0.25\alpha(\text{mm})<\beta<13.0-0.25\alpha(\text{mm}) \quad (2)$$

$$\gamma/\alpha<0.11 \quad (3)$$

where $\alpha$ is the diameter of the solid center, $\beta$ is the deformation of the solid center under a load of 30 kg at room temperature, and $\gamma$ is the deformation of the solid center frozen through the use of dry ice as measured 1 minute after application of a load of 50 kg to the frozen solid center at room temperature.

7. A process for producing a thread-wound golf ball according to claim 6, wherein $\gamma/\alpha$ is in the range of from 0.05 to 0.10.

8. A process for producing a thread-wound golf ball according to claim 6, wherein the solid center is formed of vulcanized rubber.

9. A process for producing a thread-wound golf ball according to claim 6, wherein the solid center contains a process oil having a fluid point of −10° C. or higher in an amount of 5 to 10 parts by weight based on 100 parts by weight of rubber contained in the solid center.

10. A process for producing a thread-wound golf ball according to claim 6, wherein the solid center contains natural rubber in an amount of 0 to 10 wt. % based on the total amount of rubber contained in the solid center.

* * * * *